United States Patent [19]

Thoresen et al.

[11] Patent Number: 4,749,241

[45] Date of Patent: Jun. 7, 1988

[54] DISPLAY CASE

[75] Inventors: Lisbet N Thoresen, Santa Monica; Calvin Rogers, Los Angeles, both of Calif.

[73] Assignee: The J. Paul Getty Trust, Los Angeles, Calif.

[21] Appl. No.: 924,836

[22] Filed: Oct. 29, 1986

[51] Int. Cl.[4] ..... A47F 3/00

[52] U.S. Cl. ..... 312/114; 312/31.2

[58] Field of Search ..... 312/284, 296, 114, 31, 312/45, 72, 75, 31.2; 206/204, 213.1, 205

[56] References Cited

U.S. PATENT DOCUMENTS

| | | | |
|---|---|---|---|
| 73,433 | 1/1868 | Caldwell | 34/81 |
| 84,445 | 11/1868 | Stignal | 312/284 X |
| 223,059 | 12/1879 | Mumbrue | 34/80 |
| 293,028 | 2/1884 | Hyndman | 312/114 X |
| 1,091,143 | 3/1914 | Kibbey | 312/284 X |
| 1,418,777 | 6/1922 | Cox | 206/213.1 X |
| 3,203,554 | 8/1965 | Pendergrast Jr. et al. | 312/45 |
| 4,082,390 | 4/1978 | Gibson et al. | 312/284 |
| 4,111,753 | 9/1978 | Folsom et al. | 312/1 |

*Primary Examiner*—Joseph Falk

*Attorney, Agent, or Firm*—Harris, Kern, Wallen & Tinsley

[57] ABSTRACT

A display case for supporting and viewing of a museum piece, the case including a base providing a lower chamber for a humidity buffer and a transparent cover providing an upper chamber for the piece on display. The case is substantially airtight, with sealed access ports in the base for inserting and removing humidity buffer containers, and with a clamped soft seal between the cover and base for removal of the cover to provide access to the display space. In the preferred embodiment, the humidity buffer is contained in cylindrical containers which rest on a sloping shelf in the base for ease of handling, and the lower and upper chambers are separated by a platform which provides a restricted airflow path between the chambers so that opening an access port does not result in substantial airflow into or out of the upper chamber.

12 Claims, 1 Drawing Sheet

FIG. 1
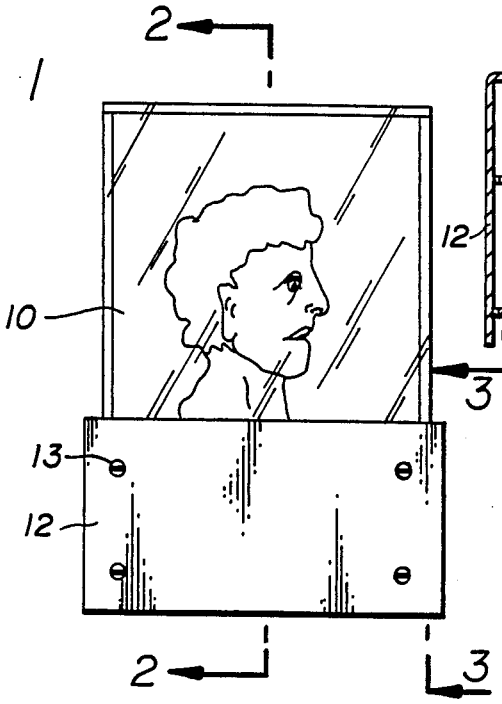
FIG. 3
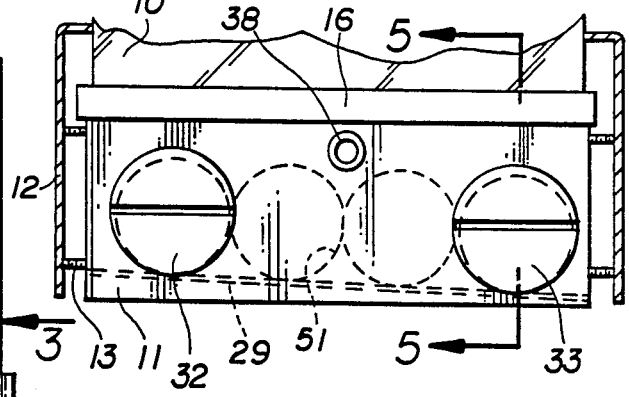
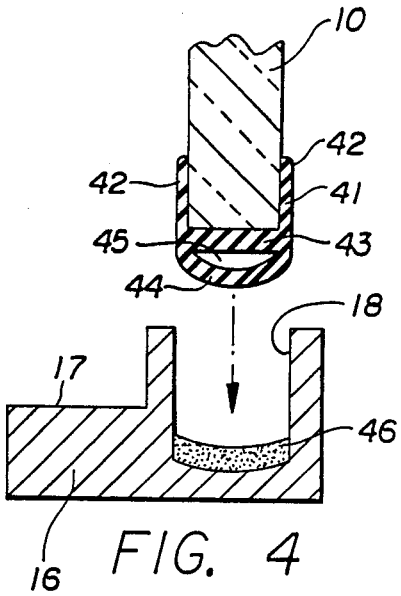
FIG. 4
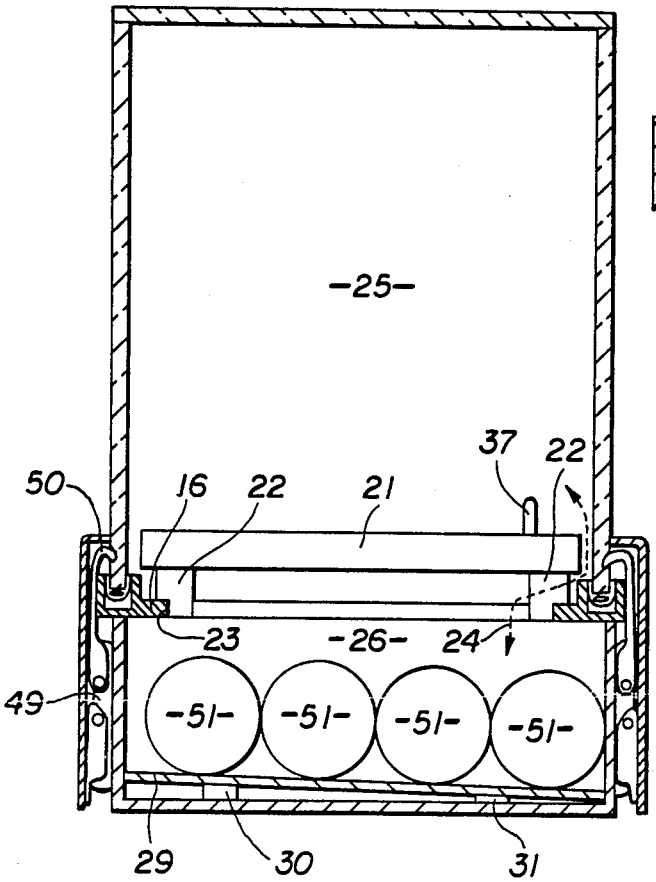
FIG. 2
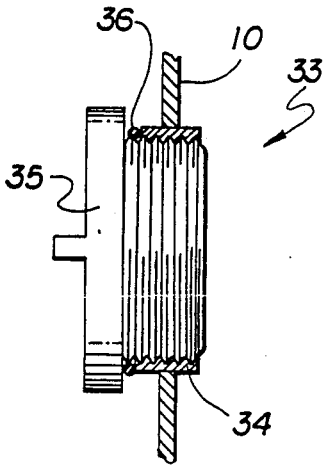
FIG. 5

DISPLAY CASE

BACKGROUND OF THE INVENTION

This invention relates to museum type display cases, and in particular, to a new and improved display case with a controlled climate therein, sometimes referred to as a microclimate.

A controlled stable microclimate is desirable for sensitive objects that should be displayed at relative humidity levels and/or temperature levels different than those of the ambient environment. A typical microclimate incorporates three basic elements and the success in providing an ideal environment for a displayed item depends upon the three: a humidity buffering material such as silica gel, a seal, and a hygrometer.

A typical display case for a microclimate has a base and a removable cover with the object on display supported on the base and with the cover transparent for viewing the object. The cover is removable for access to the object and a seal is provided between the cover and base for limiting air flow into and out of the interior of the case. The display cases almost always are rectangular in plan, with square corners.

In one conventional type of display case, an airtight seal between cover and base is sought by caulking a mastic sealant into the join between the cover and the base. At the present time, one of the silicone mastics is preferred. A humidity buffering material, or humidity buffer, typically silica gel, is carried in an open tray in the base for controlling humidity within the case.

Silica gel is an inert amorphous material and in granular form has vast surface area for adsorption and desorption of moisture. After conditioning in an environmental chamber or over saturated salt solutions of a desired relative humidity value, the silica gel can be placed in a sealed case or container and will adsorb and desorb moisture in the container, maintaining the relative humidity within the container at the conditioned value of the silica gel. With a sufficient amount of silica gel and appropriate application, along with an effective seal, longterm buffering stability can be obtained within the container. However, the buffering stability and capacity of the silica gel is compromised by leakage of the container's seals. Outside air leaking into the container will cause the silica gel to equilibrate with the changed environment resulting in the requirement for reconditioning the silica gel to the desired relative humidity level in the manner described above.

Each time access to the case is required for servicing the humidity buffer or calibrating the hygrometer or for access to the object on display, it is required to slice through the sealant and sometimes the join to remove the cover. Then before resealing, the old mastic must be removed from the base and the cover, typically by scraping, in order to obtain a new seal when the parts are again calked and reassembled. This type of seal is not attractive, its use is messy, and it is a time consuming operation to remove an old sealant and apply a new sealant. Sometimes the case is damaged during this operation, and the actual effectiveness of this type of seal is in doubt.

With this type of case, considerable time and effort are required for maintaining the case. Typically the humidity buffer must be serviced every two months and two to three people are required to perform the removal and replacement in a safe manner.

In another conventional type of display case for achieving a controlled stable microclimate, an airtight seal is sought by welding an acrylic frame to the edge of the display cover. A pair of concentric grooves are machined in the frame, with the grooves curving around the corners of the frame and with one continuous length of a seal ring inserted into each groove. The seal is obtained by compressing the cover and the attached frame and rings against the acrylic back or base of the display case. Compression is maintained by placement of screws through the back or base and into the frame between the seal rings. The screws are usually placed at two to three inch intervals.

This type of case is costly due to the labor intensiveness in fabrication of the sealing mechanisms, which must be repeated for each and every case. Servicing this type of microclimate requires removing the case to the conservation laboratory in order to access the hygrometer for calibration and/or the humidity buffer for regeneration and/or the object on display for inspection. Considerable care and time are required to replace the screws in order to prevent the planar surfaces of the acrylic frame and acrylic base or back from warping and in order to ensure that uniform tension is exerted upon the seal rings.

Even when handled with optimum care, this method of seal application is highly imperfect. Firstly, the seal rings are stressed at the location of the adjacent screws even when tension may be uniform on one screw with respect to another screw. These stress points fatigue the seal rings and over time leakage results. Secondly, regardless of the uniformity of tension exerted upon the acrylic frame and base or back, a planar surface will always tend to twist or warp when subjected to compressive force. This is the nature of acrylic sheet regardless of its thickness, and may be likened to grain direction. When pressure is exerted on the cross-grain the warping problems is eliminated.

The seals in such display cases have to be carefully specified and correctly implemented in order to work satisfactorily; the methods and the materials used in forming the seals must be applied correctly. Also, the deep open tray storage of the humidity buffer material is not efficient as the lower material in the tray is not easily accessible to the atmosphere. Maximum area of the humidity buffer should be exposed to the atmosphere for optimum performance. Also it is desirable to have the humidity buffer material out of view.

It is an object of the present invention to provide a new and improved display case which has low maintenance requirements with respect to the case itself, to servicing the humidity buffer, and to hygrometer calibration. A further object is to provide such a display case which is of a design that is readily adapted to cases of various sizes and various configuration, including the most widely used rectangular plan with square corners. An additional object is to provide such a display case which is easy and simple to operate with simple closure mechanisms that do not require high-level technique or extensive time to operate.

It is a particular object of the invention to provide a display case having an upper chamber for display and a concealed lower chamber for the humidity buffer, with separate access to the lower chamber for changing humidity buffer and to the upper chamber for access to the object on display. An additional object is to provide a display case which can utilize conservation-safe materials throughout and which to a substantial degree, utilizes stock items rather than custom fabricated components. A most important object is to provide a display case which meets these various requirements and also is aesthetically acceptable in the envirnonment in which it will be used.

It is an object of the invention to provide a display case incorporating a solid seal construction which is easily closed and opened repeatedly, rather than utilizing the conventional sticky mastic sealant. An additional object is to provide such a case incorporating provisions for adjusting the sealing pressure around the perimeter of the join between cover and base in order to achieve a uniform sealing pressure. These and other objects, advantages, features and results will more fully appear in the course of the following description.

SUMMARY OF THE INVENTION

A display case for supporting and viewing of a museum piece or the like and having a base and cover, with the base and cover having interengaging seal means for providing an airtight seal therebetween, with a shelf carried in the base for supporting a humidity buffer container and access port means in the base for removing and replacing humidity buffer containers. The preferred embodiment of the invention includes a support platform in the base dividing the case into a lower chamber and an upper chamber and defining a restricted air flow path between the chambers, with the shelf in the lower chamber and mounted in a sloping orientation with an access port adjacent the upper edge of the shelf and an access port adjacent the lower edge of the shelf. Also in the preferred embodiment, the seal means includes an upwardly opening groove in the base and a deformable gasket carried on the lower edge of the cover for positioning in the groove, with the gasket and groove providing intimate contact for optimum sealing. The preferred embodiment also includes adjustable latches along the outer periphery of the base for engaging and clamping the cover in place, with latch adjustment providing for achieving uniform tension around the perimeter.

BRIEF DESCRIPTION OF THE DRAWING

FIG. 1 is a side view of a display case incorporating the presently preferred embodiment of the invention;

FIG. 2 is an enlarged sectional view taken along the line 2—2 of FIG. 1;

FIG. 3 is an enlarged partial sectional view taken along the line 3—3 of FIG. 1;

FIG. 4 is an enlarged partial sectional view illustrating the interengaging seal means of FIG. 2; and FIG. 5 is an enlarged partial sectional view taken along the line 5—5 of FIG. 3.

DESCRIPTION OF THE PREFERRED EMBODIMENT

The preferred embodiment of the display case as shown in the drawing figures includes a cover 10 resting on a base 11. If desired, side panels 12 may be attached to the base 10 by screws 13 to serve as a shroud around the base. The cover typically is formed of four clear plastic vertical panels and one clear plastic horizontal panel which are cemented together to form a substantially airtight and substantially transparent cover, with the bottom open. Preferably, the cover is rectangular in plan with square corners, the configuration presently preferred for museum display cases. The embodiment illustrated in the drawing is square in plan.

The base 11 has four sides and a closed bottom, with open top. A seal frame 16 is fixed to the upper edge of the base 11, with the frame having four sides and an open center. Typically the frame is machined from a solid sheet of aluminum, with a cross section as shown in FIG. 4, with an upwardly opening groove 18 and a window 17 cut from the center of the sheet.

A support platform 21 is provided within the case for supporting the object to be displayed. Feet 22 are provided for supporting the platform 21, and preferably the feet are positioned adjacent the corners of the platform and have notches 23 for fitting within and centering the platform on the frame 16. With this configuration, a restricted air flow path is provided between the upper chamber 25 within the cover, and the lower chamber 26 within the base, as shown by the dashed line 24.

A shelf 29 is carried within the base on supports 30, 31 so that the shelf slopes from one side of the base to the other, as seen in FIG. 2. Two access ports 32, 33 are provided in the base, with the port 32 adjacent the high end of the shelf 29 and with the port 33 adjacent the low end of the shelf. The port 33 is shown in greater detail in FIG. 5 and includes an annular sleeve 34 fixed in an opening in the side of the base, and a plug 35 for closing the opening in the sleeve. The sleeve and plug have interengaging threads, and an 'O' ring 36 is positioned around the plug for providing a seal between the sleeve and plug when the plug is screwed into place. When desired an electrical type hygrometer 37 is mounted on the platform 21 and is connected to an electrical plug 38 in a side of the base to provide outside access to the hygrometer without requiring opening of the case.

The case includes means for providing an airtight seal between the cover and the base. A gasket 41 is carried on the lower edge of the cover. Typically the gasket is an extrusion of a soft flexible material, typically a full, post cured silicone gasket material, having a cross section shape as shown in FIG. 4. In the preferred embodiment illustrated, the gasket 41 has spaced flanges 42 providing a groove for receiving the lower edge of the cover, a transverse member 43 between the flanges 41, and a depending seal section 44, with an air space 45 between the seal section 44 and the transverse member 43. Pinholes are provided in the depending section 44 to allow evacuation of the air in the space 45 on compression of the gasket. This form of gasket is sometimes referred to as an A channel gasket due to its resemblance to an inverted A. The groove 18 is machined to the contour of the gasket 42 providing a snug conformal engagement with the seal section 44 of the gasket. Also, the pressure produced by the engagement compresses the gasket at the space 45 thereby causing the gasket to bulge laterally and engage the walls of the groove 18. A solid yet soft sealant 46 may be positioned in the bottom of the groove 18 of the frame 16 if desired. Preferably the gasket 41 is an extrusion which is miter cut to the desired lengths and joined at the corners with a silicone adhesive.

Latches 49 are mounted on the base and provide for clamping the cover against the base. Typically two or more latches are provided along each side of the base, with each latch having a head 50 with a hook at the upper end for engaging a groove in the outer surface of the cover adjacent the lower edge. The latches preferably are adjustable to vary the position of the hook relative to the main portion of the latch which is attached to the base. This adjustment provides for controlling the clamping pressure which is exerted on the seal and permits obtaining a substantially uniform clamping pressure around the periphery of the junction between the cover and base. The adjustable latches may be conventional in design, and sometimes are referred to as Adjustable Draw Latches. In the preferred form of latch disclosed, the latch head 50 is made several inches wide to provide a long engagement with the groove in the cover.

In operation when it is desired to install or remove an object, the side panels are removed, the latches are unlatched and the hooks withdrawn from the groove in the cover, and the cover is lifted upwardly off the base. The object on display is removed from the platform, or an object is placed on the platform in the desired position, the cover is lowered into place, the hooks are positioned in the cover groove and the latches are closed. The cover removal and reattachment is carried out without requiring any attention to the cover/base seal and no servicing or replacement of the seal is required. The restricted air flow path between the upper and lower chambers of the case reduces the air exchange in the lower chamber and hence the exposure of the humidity buffer to the ambient atmosphere.

The preferred type of humidity buffer container for the display case is an apertured tube which can be impregnated with crushed silica gel and which can be filled with silica gel beads. The tube preferably is cylindrical in nature with a perforated or porous or screen mesh wall or the like, and four such tubes 51 are shown in FIGS. 2 and 3. When it is desired to change humidity buffer containers, the port 33 is opened and the tube at the port is extracted. The remaining tubes roll down the sloping shelf, and each is removed in sequence. The port 33 is then closed and the port 32 is opened. The desired number of humidity buffer containers are inserted through the port 32, with each container rolling down the shelf until the base is filled. Then the port 32 is closed. This type of silica gel exchange is accomplished quickly and without disturbing the object on display and with a minimum of air interchange between the ambient and the lower chamber 26, and with an even less exchange of air in the upper chamber 25.

Thus it is seen that the desired objects of the invention are achieved in a display case which utilizes readily available materials and components and which is easily and quickly operated without requiring special expertise or techniques. Moreover the objects of the invention are achieved in a display case which requires only a minimum number of persons for servicing and which requires only a minimum of servicing in order to maintain the desired relative humidity over time.

We claim:

1. In a passive sealed display case for supporting and viewing of a museum piece or the like in a controlled humidity environment, the combination of:

a substantially airtight base having a bottom and sides and an open interior;

a substantially airtight and substantially transparent cover positioned above said base;

said base and cover having interengaging seal means for providing a substantially airtight seal between said base and cover;

a shelf carried in said base for supporting a humidity buffer container;

access port means in a side of said base for removing and replacing humidity buffer containers, said port means including means defining an opening in said side for passage of containers into and out of said base, and a movable cover means for said opening; and a support platform mounted at said base above said shelf dividing said case into a lower chamber and an upper chamber and defining a restricted airflow path between said chambers;

with said shelf having an upper surface which slopes from an upper edge to a lower edge, and with said access port means including a first port adjacent said upper edge for inserting a humidity buffer container and a second port adjacent said lower edge for removing a humidity buffer container.

2. A display case as defined in claim 1 wherein said access port means includes a cover for each port to provide a substantially airtight seal at the port.

3. A display case as defined in claim 2 wherein each of said ports is circular with an O-ring seal for the port cover.

4. A display case as defined in claim 1 including a plurality of humidity buffer containers disposed in side by side relation on said shelf, with each of said containers comprising an apertured tube packed with a humidity buffer.

5. A display case as defined in claim 1 including a plurality of latches carried on said base, and an exterior cover groove in said cover, with said latches having means for engaging said cover groove for urging said cover and said base together, with said latches being adjustable to provide substantially equal sealing pressure along said seal means.

6. A display case as defined in claim 1 including a relative humidity sensor mounted within said case above said seal means, a sensor plug mounted in said base, and an electrical cable interconnecting said sensor and said plug for external monitoring of said sensor.

7. A display case as defined in claim 1 wherein said base and cover are polygonal in plan.

8. A display case as defined in claim 1 wherein said base and cover are rectangular in plan with square corners.

9. A display case as defined in any of claims 1, 2, 3, 4, or 5–8 wherein said seal means includes an upwardly opening seal groove in the upper edge of said sides of said base, and a gasket carried on the lower edge of said cover with said gasket having a preformed channel cross section for positioning on said lower edge and having an open interior and being slideable into and out of said seal groove.

10. A display case as defined in claim 9 including a soft solid sealant carried in the bottom of said seal groove, and with insertion of said gasket into said seal groove in engagement with said soft sealant compressing said gasket vertically to expand said gasket laterally into engagement with said seal groove wall.

11. In a passive sealed display case for supporting and viewing of a museum piece or the like in a controlled humidity environment, the combination of:

a substantially airtight base having a bottom and sides and an open interior;

a substantially airtight and substantially transparent cover positioned above said base;

said base and cover having interengaging seal means for providing a substantially airtight seal between said base and cover;

a shelf carried in said base for supporting a humidity buffer container, with said shelf having an upper surface which slopes from an upper edge to a lower edge;

access port means provided with a removable cover in a side of said base for removing and replacing humidity buffer containers, said access port means including a first port adjacent said upper edge for inserting a humidity buffer container and a second port adjacent said lower edge for removing a humidity buffer container;

a support platform mounted at said base above said shelf dividing said case into a lower chamber and upper chamber and defining a restricted airflow path between said chambers.

12. A display case as defined in claim 11 including a plurality of humidity buffer containers disposed in side by side relation on said shelf, with each of said containers comprising an apertured tube packed with a humidity buffer.

* * * * *